US006511210B2

(12) United States Patent
Gampe et al.

(10) Patent No.: US 6,511,210 B2
(45) Date of Patent: Jan. 28, 2003

(54) OPERATING-ROOM LIGHTING DEVICE WITH A LIGHTING UNIT COMPRISING A DISCHARGE LAMP

(75) Inventors: Uwe Gampe, Flörsheim (DE); Jörg Eduard Hartge, Gelnhausen (DE); Rudolf Marka, Frankfurt (DE)

(73) Assignee: Heraeus Med GmbH, Hanau (DE)

( * ) Notice: Subject to any disclaimer, the term of this patent is extended or adjusted under 35 U.S.C. 154(b) by 0 days.

(21) Appl. No.: 09/805,087

(22) Filed: Mar. 13, 2001

(65) Prior Publication Data

US 2001/0030867 A1 Oct. 18, 2001

(30) Foreign Application Priority Data

Mar. 13, 2000 (DE) ..... 200 04 384 U

(51) Int. Cl.[7] ..... F21V 7/00

(52) U.S. Cl. ..... 362/296; 362/387; 362/335; 362/346; 362/804

(58) Field of Search ..... 362/302, 398, 362/804, 327, 335, 299, 346

(56) References Cited

U.S. PATENT DOCUMENTS 4,600,979 A * 7/1986 Fisher et al. ..... 362/373
5,791,768 A * 8/1998 Splane, Jr. ..... 362/280
5,861,706 A * 1/1999 Lapatovich et al. ..... 313/113

FOREIGN PATENT DOCUMENTS

DE 23 27 415 C2 4/1982
DE 34 32 745 C2 8/1986

* cited by examiner

*Primary Examiner*—Stephen Husan
*Assistant Examiner*—Bertrand Zeade
(74) *Attorney, Agent, or Firm*—Cohen, Pontani, Lieberman & Pavane

(57) ABSTRACT

An operating-room lighting device with an inner lighting unit that includes at least one discharge lamp and an inner reflector in a housing. The lighting unit is at least partially enclosed by an outer annular housing with an annularly or polygonally designed reflector for convergent deviation of light emitted by the lighting unit into an illumination field. The outer reflector includes, on its side facing the inner lighting unit, a closed transparent surface whose back adjoins a reflective layer. The reflective layer is applied to the back of the transparent surface. The inner lighting unit and the outer reflector are held together by a connecting member, which is articulated to a curved intermediate piece for attachment to a stationary support. It is therefore possible to provide an operating-room lighting device having a high illumination intensity, which supplies the illumination field, on the one hand, with light from a large diameter and, on the other hand, from a small diameter, so as to offer both good lighting of narrow wounds and good illumination behind possible obstacles. The lighting unit is furthermore compactly designed and suitable for laminar flow in order to avoid contamination in the environment of the operation-room field.

9 Claims, 3 Drawing Sheets

OPERATING-ROOM LIGHTING DEVICE WITH A LIGHTING UNIT COMPRISING A DISCHARGE LAMP

BACKGROUND OF THE INVENTION

1. Field of the Invention

The present invention relates to an operating-room lighting device with an inner lighting unit that comprises at least one discharge lamp and an inner reflector in a housing. The lighting unit is at least partially enclosed by an outer annularly or polygonally designed reflector for convergent deviation of light emitted by the lighting unit into an illumination field.

2. Description of the Related Art

German reference DE 23 27 415 C2 discloses an operating-room lighting device with an almost point light source, which is designed as a discharge lamp. The light source is enclosed by a cylindrical graduated lens arrangement for concentrating the light emitted by the light source, which radiates spherically, into a light plane, and is provided with a plurality of reflectors circularly enclosing the light source as the mid-point in this light plane. The reflectors are held in a ring arrangement and the light incident on them from the light plane is deviated so that it converges onto a circular surface below the reflector ring. A lens arrangement, which comprises a plurality of cylindrical lenses that are circularly organized in succession and are perpendicular to the light plane, is provided between the graduated lens arrangement and the reflector ring.

German reference DE 34 32 745 C2 discloses an operating-room lighting device for uniformly illuminating an operating-room field without oblique shadows, in which outer deviating mirrors and inner deviating mirrors are each designed as a reflector ring with a common ring axis. A light source is arranged on the ring axis.

In the case of conventional lighting devices, the extensive structure of the lighting units and their large-area heating impairs the laminar flow of the ventilated ceiling. A hot lighting unit can cause upward convection currents and therefore turbulence in the air; this makes it possible for contamination to reach the operating-room field from the surroundings. Simple cleaning requires a closed lighting unit with a smooth surface.

SUMMARY OF THE INVENTION

The object of the present invention is to provide a lighting unit having a high illumination intensity, which supplies the operating-room field with light from a large diameter and, at the same time, from a small diameter, so as to offer good lighting of narrow wounds, on the one hand, while permitting good illumination behind obstacles, on the other hand. The lighting unit should furthermore be compactly designed and suitable for laminar flow in order to avoid contamination of the operating-room field from the surroundings.

The object is achieved in that the outer reflector comprises, on its side facing the inner lighting unit, a transparent surface (which may in particular be closed) whose back adjoins a reflective layer.

The term transparent surface is intended to denote a transparent body whose cross section is small in comparison with its surface area.

In a preferred embodiment of the invention, the reflective layer is applied to the back of the transparent surface. In this case, the reflector surface is protected from damage by impact or abrasion/corrosive media. The reflector is furthermore easy to clean.

A discharge lamp is preferably used as the lamp for normal functioning.

For a lighting device with high failure safety, a backup lamp function should furthermore be provided, in case the discharge lamp or its power supply is compromised by malfunctions. The backup lamp is ideally a halogen lamp, which can preferably be operated from the power supply available for the discharge lamp.

In its preferred embodiment, the lighting unit is made from an inner lighting unit (which may in particular be closed) with a discharge lamp and an additional light source, as a backup lamp, and an associated optical system, an annular housing, arranged at a radial distance in the range of from 50 to 150 mm (preferably 100 mm), with an outer reflector and a member connecting the two components—i.e. a connecting member. The connecting member is articulated to a curved intermediate piece for attachment of the operation-room lighting device to a stationary support. In this case, normal functioning exploits the favorable property of the discharge lamp that it produces comparatively little heat at a high light flux; it is therefore possible to fit the lamp in a compact inner lighting unit which permits good lighting even of narrow wounds—for example during a surgical procedure. Obstacles can be illuminated from behind using the ring reflector which is arranged at a radial distance. Since the latter does not become heated by the inner lighting unit, owing to the spatial separation, it advantageously produces no convection current that perturbs the laminar flow.

A simple compact structure proves to be particularly advantageous, and at the same time a smooth or polished surface allows the possibility of easy cleaning.

In a preferred embodiment, the inner lighting unit and the outer ring reflector are held together by a connecting member, which on the one hand ensures thermal decoupling between the two and, at the same time, provides the space for accommodating the axial attachment for a stationary support, in particular for a ceiling support, and the space to install electronic component. It is furthermore possible to frame the outer ring reflector with a protective housing.

In this case, it proves advantageous that temperature-sensitive components, such as a ballast device and any electric motors that may be necessary, can be fitted in the connecting member which connects the inner lighting unit to the outer ring reflector and is comparatively cool even during functioning. The connecting member is arranged above the outer ring reflector, so that the lighting unit is both readily accessible from below and easy to clean.

The inner lighting unit advantageously comprises an additional light source as a backup lighting device, for which an incandescent halogen lamp has in particular proved suitable. It is therefore possible, in case of malfunctions or failure in the functioning of the discharge lamp, to provide emergency lighting by means of a halogen lamp, its probability of failure being very low owing to a simplified power supply.

The outer ring reflector preferably comprises a diffusing structure on its side facing the surroundings. In this case, the ring reflector is designed, on its side facing the inner lighting unit, as an externally faceted transparent plastic part with a mirrored back. The preferred material for producing the reflector is acrylic resin. The outer housing of the ring reflector consists of metal or plastic, preferably polyurethane. The reflective layer is preferably evaporation-coated or sputtered onto the back of the transparent plastic part.

The outer housing renders the ring reflector insensitive to impact loads from outside, and the mirroring on the back is therefore protected from damage. The transparent plastic protects the mirroring on the back from damage due to mechanical stress and chemical attack by corrosive media. In this way, it is advantageously possible to make do without an additional protective disk, which would impair the transmission and therefore cause loss of light. The lighting unit is hence comparatively lightweight.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PREFERRED EMBODIMENTS

Figure 1A:
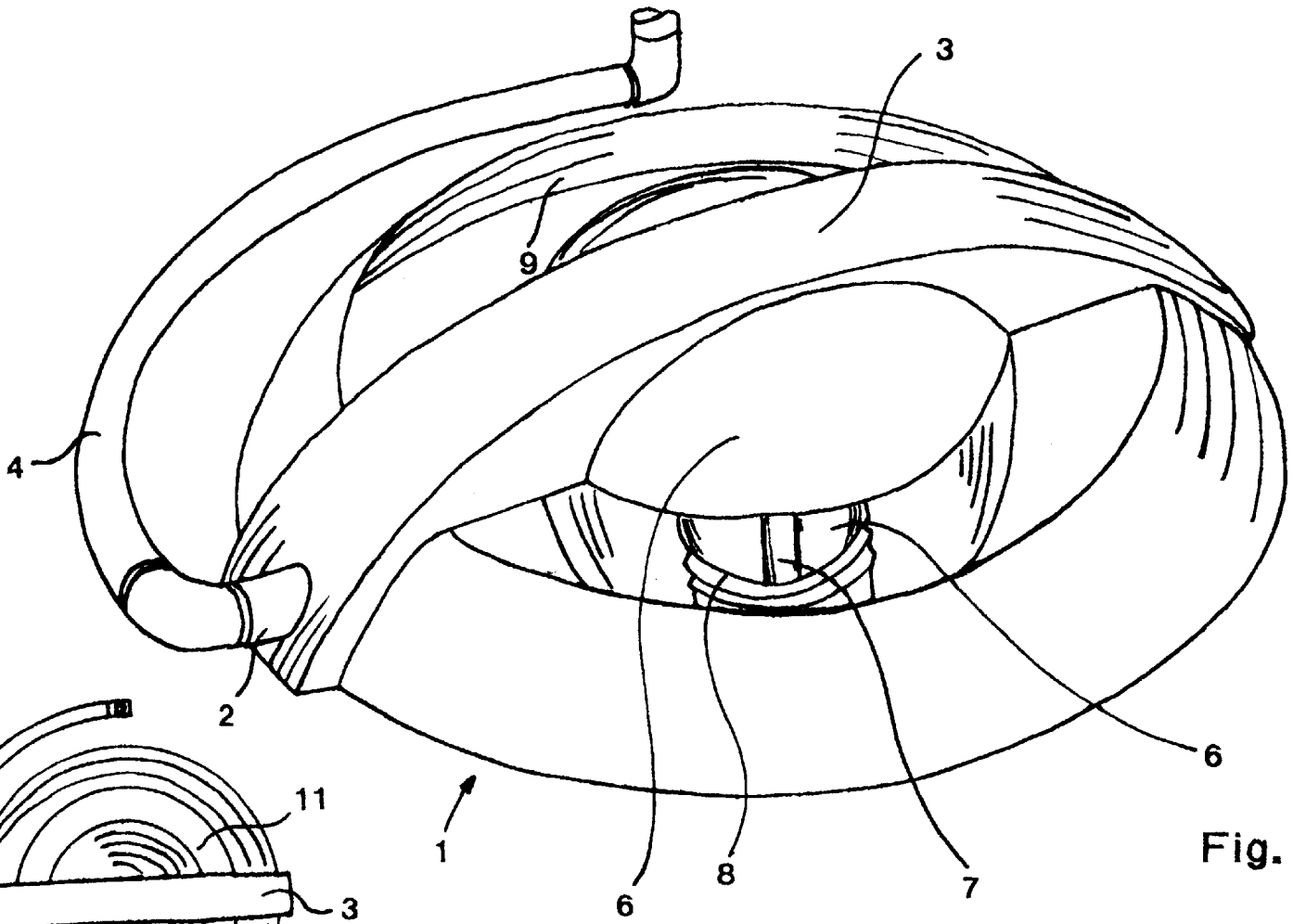
FIG. 1*a* shows an operation-room lighting device according to the invention in perspective representation.

According to FIG. 1*a*, the lighting device housing 1, provided with an inner lighting unit 6, an outer reflector 9 and a connecting member 3, is articulated by an axial connection 2 in the vicinity of the connecting member 3 to a curved intermediate support piece 4, which is attached to a stationary support, in particular a standard ceiling support for operation-room lighting devices. The curved intermediate support piece 4 permits universal adjustment of the lighting device housing 1, in order to obtain optimum positioning for the illumination in the operating-room field on the patient.

Connected to the connecting member 3 is the inner lighting unit 6, which comprises a discharge lamp 7 (symbolically represented here) enclosed by an axially symmetric lens arrangement 8 for projecting the light emitted by the discharge lamp. The light is in this case directed outward in the vicinity of the plane of the reflector, also referred to as the outer ring reflector 9, which annularly or polygonally encloses the inner lighting unit 6.

Figure 1B:
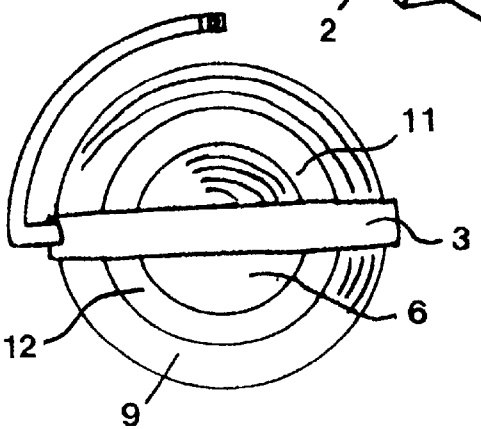
FIG. 1*b* schematically represents the lighting device with a ring reflector in a plan view.

FIG. 1*b* shows, in a plan view from above, the inner lighting unit 6 with the outer ring reflector 9 enclosing it in the radial direction, the two parts being held together by the connecting member 3. Between the inner lighting unit 6 and the ring reflector 9, with the exception of the region covered by the connecting member 3, a sector of a concentric opening 11, 12 is in each case visible, through which the flow of air can pass unimpaired, so that a laminar flow of the ventilated ceiling is not perturbed. This stops any contamination from the surroundings reaching the actual region of the operating-room field. This is further reinforced by the fact that the housing of the outer reflector 9 remains cold when the lighting device is functioning.

Figure 2:
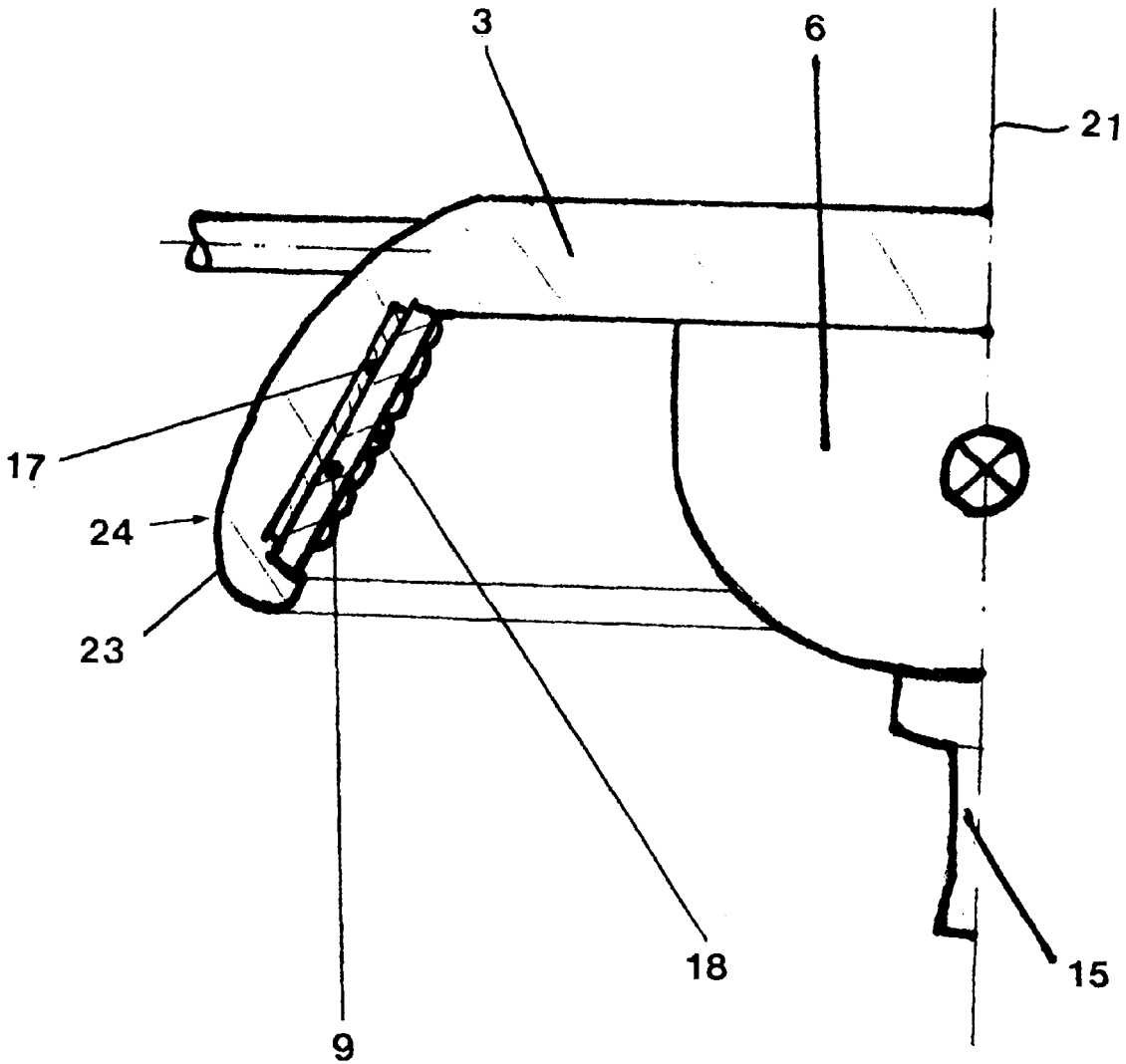
FIG. 2 schematically shows a partial section in the radial direction through the ring reflector, the reflective layer and the outer housing of the ring reflector, as well as the inner lighting unit, being visible.

The ring reflector 9 comprises, according to FIG. 2, a closed transparent surface on its side facing the inner lighting unit 6, with a reflective layer 17 being applied to the back of this surface. The reflective surface is of smooth design on its surface, whereas externally, i.e. on the side next to the inner lighting unit, it comprises a diffusing structure 18. The diffusing structure has the particular advantage that it renders the surface insensitive to scratching and ensures a uniform light distribution in the field.

The reflective layer 17 is in this case protected by a ring housing 23, which consists of plastic on its side 24 facing outward. In this case, it has proved advantageous that both the inner lighting unit 6 of the ring housing and the ring reflector 9 comprise a smooth or weakly structured external surface, so that they can be readily cleaned together with the connecting member 3, as is actually necessary for medical applications. The longitudinal axis of the lighting unit is denoted by the reference number 21.

The inner lighting unit has a handle 15 in the lower region for optimum positioning of the operating-room lighting device with respect to the operating-room field.

It is advantageously possible to make do without an additional protective disk for covering the ring reflector, which would at the same time entail a loss of light intensity due to attenuation. This in turn reduces the weight of the lighting unit.

Figure 3:
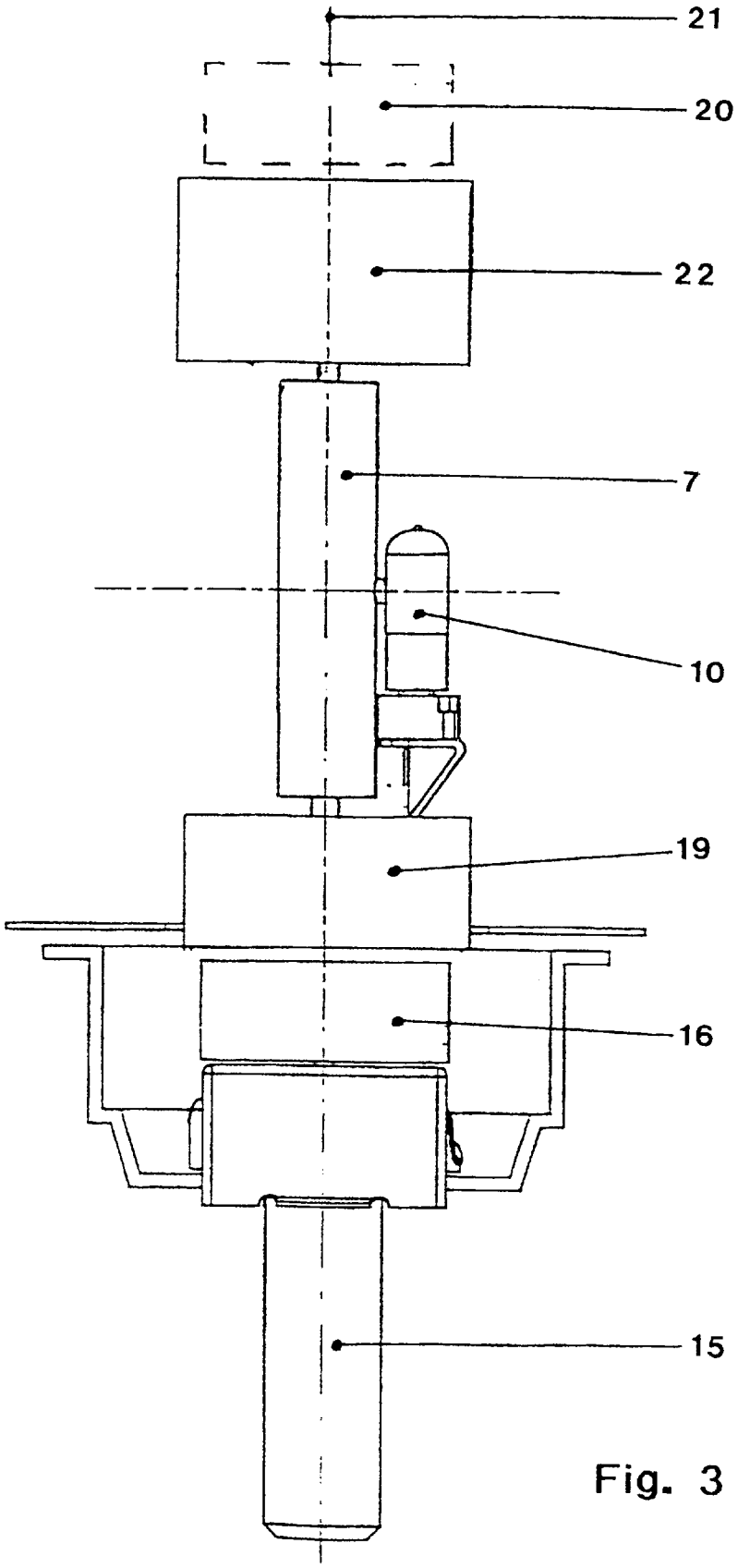
FIG. 3 shows, in a schematic representation, a longitudinal section of the lamp unit with an inner lighter device housing and a handle for positioning the lighting device.

With the aid of the lamp unit represented in longitudinal section in FIG. 3, it can be seen that an ignition device 16, required for starting up the discharge lamp, is located in the region between the handle 15 for adjusting the lighting device and a first socket 19 for the discharge lamp 7, or alternatively above a second socket 22 of the discharge lamp 7 in position 20. The discharge lamp 7 is additionally held by the second socket 22 arranged along the lighting device axis 21, the contact made via the first and second sockets 21, 22 permitting a sufficiently high striking voltage without any possible occurrence of voltage sparkovers. The radiation emitted by the discharge lamp 7 is directed by the projection, in the radial direction, to the outer ring reflector (not shown here), so that radiation with high intensity strikes the reflective region of the ring reflector, is then converged along the direction of the lighting device axis 21 and hence lights the illumination field on the patient.

This provides the advantage that the power supply of the discharge lamp, with its high-voltage part, and the ignition device do not need to be disconnected when changing the lamp. Any necessary disconnection for maintenance work can be carried out on the primary side of a high-voltage transformer.

The incandescent halogen lamp provided as the backup lamp 10 is arranged immediately beside the discharge lamp 7, so that the beam path of the light emitted by it corresponds essentially to that of the discharge lamp 7.

Thus, while there have been shown and described and pointed out fundamental novel features of the present invention as applied to a preferred embodiment thereof, it will be understood that various omissions and substitutions and changes in the form and details of the devices illustrated, and in their operation, may be made by those skilled in the art without departing from the spirit of the present invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

We claim:

1. An operating-room lighting device, comprising: an inner lighting unit having a housing and at least one lamp and an inner reflector in the housing; an outer annular housing arranged to at least partially enclose the lighting unit, the outer annular housing having one of an annularly and polygonally shaped outer reflector for convergent deviation of light emitted by the lighting unit into an illumination field, the outer reflector having a side facing the inner lighting unit with a transparent member with a back surface, and a reflective layer adjoining the back surface; a connecting member arranged to hold the inner lighting unit and the outer reflector together, so that the outer reflector is arranged at a radial distance from the inner lighting unit; and a curved intermediate piece, the connecting member being articulated to the curved intermediate piece which is attachable to a stationary support.

2. An operating-room lighting device as defined in claim 1, wherein the reflective layer is applied to the back surface of the transparent member.

3. An operating -room lighting device as defined in claim 1, wherein the lamp is a discharge lamp.

4. An operating-room lighting device as defined in claim 3, wherein the inner lighting unit comprises an additional light source as a backup lamp arranged so that at least some radiation from the backup lamp is deliverable through the reflector provided for projecting light emitted by the discharge lamp.

5. An operating-room lighting device as defined in claim 1, wherein the reflector is ring shaped and comprises a diffusing structure on a side facing the inner lighting unit.

6. An operating-room lighting device as defined in claim 5, wherein the diffusing structure is arranged on the transparent member of the ring reflector.

7. An operating-room lighting device as defined in claim 1, and further comprising a ballast device, for operating the lamp, in the connecting member, outside the inner lighting unit.

8. An operating-room lighting device as defined in claim 3, and further comprising an ignition device arranged directly one of above and below the lamp and operative for turning on the discharge lamp.

9. An operating-room lighting device as defined in claim 1, wherein the ring deflector comprises at least two segments.

* * * * *